US008919551B2

(12) United States Patent
Doplaga et al.

(10) Patent No.: US 8,919,551 B2
(45) Date of Patent: Dec. 30, 2014

(54) FIBREBOARD REINFORCED CONTAINER

(76) Inventors: Joseph Doplaga, Toronto (CA); Bob Schmitte, Lynden (CA)

( * ) Notice: Subject to any disclaimer, the term of this patent is extended or adjusted under 35 U.S.C. 154(b) by 317 days.

(21) Appl. No.: 12/796,356

(22) Filed: Jun. 8, 2010

(65) Prior Publication Data

US 2011/0297737 A1 Dec. 8, 2011

(51) Int. Cl.
*B65D 85/68* (2006.01)

(52) U.S. Cl.
USPC ..... 206/335; 206/588; 206/586; 206/521

(58) Field of Classification Search
USPC ..... 206/335, 453, 522–594, 486, 320, 521
See application file for complete search history.

(56) References Cited

U.S. PATENT DOCUMENTS

| | | | | |
|---|---|---|---|---|
| 2,273,544 | A * | 2/1942 | Vandervort | 206/335 |
| 2,762,502 | A * | 9/1956 | Lehman | 206/335 |
| 2,967,009 | A * | 1/1961 | Lidgard | 206/448 |
| 3,133,687 | A * | 5/1964 | Fremion | 206/454 |
| 5,813,537 | A * | 9/1998 | DeReu et al. | 206/453 |
| 6,095,061 | A | 8/2000 | Perazzo | |
| 6,207,242 | B1 * | 3/2001 | Hoffman | 428/34.2 |
| 6,679,378 | B1 | 1/2004 | Vermeulen et al. | |
| 7,458,465 | B1 | 12/2008 | Dahl et al. | |
| 7,665,280 | B2 | 2/2010 | Youell, Jr. et al. | |
| 2004/0007493 | A1 * | 1/2004 | Morell et al. | 206/521 |
| 2004/0129589 | A1 * | 7/2004 | Tucker et al. | 206/335 |

* cited by examiner

*Primary Examiner* — Mickey Yu
*Assistant Examiner* — Chun Cheung
(74) *Attorney, Agent, or Firm* — Miller Thomson, LLP

(57) ABSTRACT

This invention relates to a container for a part and in particular relates to a container for an automotive part having fiberboard with a hole there through for engaging the automotive part as well as a method of packaging a part with a protrusion; and in particular relates to a method of packaging an automotive hood have a protruding latch striker. This invention also relates to a corrugated paperboard package having a fiberboard insert as well as a method of protecting the shipment of automotive parts by utilizing a laminated stack of corrugated paperboard and fiberboard having a hole there through for engagement with the striker latch of the hood.

12 Claims, 13 Drawing Sheets

FIBREBOARD REINFORCED CONTAINER

FIELD OF INVENTION

This invention relates to a container for a part and in particular relates to a container for an automotive part having fiberboard with a hole there through for engaging the automotive part as well as a method of packaging a part with a protrusion; and in particular relates to a method of packaging an automotive hood have a protruding latch striker. This invention also relates to a corrugated paperboard package having a fiberboard insert as well as a method of protecting the shipment of automotive parts by utilizing a laminated stack of corrugated paperboard and fiberboard having a hole there through for engagement with the striker latch of the hood.

BACKGROUND TO THE INVENTION

There are a variety of companies shipping parts all over the world. Generally speaking automotive parts for assembly are shipped in bulk by rail, truck or by ship. After market parts in the automotive industry can be shipped in the same way, however there is a need for a faster and less expensive way of shipping one part at a time, either by courier or the like.

Vehicle or automotive parts also tend to wear out or need to be replaced following an accident. Such vehicle parts include doors, fenders, hoods, as well as trunks.

Since vehicle body parts are generally large or require substantial amount of storage space it is generally required that such vehicle parts are warehoused at the manufacturing site to be shipped to automotive body shops or the like when required. Accordingly, it is not unusual that such vehicle parts are shipped one at a time which raises the price of repairs.

Accordingly, it would be preferable if such vehicle parts such as a hood of a vehicle could be shipped in a package through a number of couriers including FedEx and Purolator.

However, because of the weight of the vehicle parts including the hood of an automobile, it is not unusual that such parts arrive at the desired destination with dents or the like due to the package being dropped or accidentally dented. Thus, there is a high percentage of vehicle hoods which arrive in a damaged condition and need to be repaired prior to usage.

Accordingly, there has been a need in prior art to develop an improved package and method of shipping vehicle parts. There have been various attempts to provide such packages. For example U.S. Pat. No. 7,665,280 teaches that plies of paperboard are laminated to form a paperboard laminate having a front and a back. An automobile part is placed on the front of the paperboard laminate leaving exposed the front of the paperboard laminate. The automobile part and the exposed paperboard laminate are shrink-wrapped with plastic shrink-wrap material. For automobile window glass, some of the front side plies of the paperboard laminate have been cut out to form a cavity in the configuration of the glass product being packaged. The glass product is disposed in the cavity and a glass product conforming reinforcing block is placed against the backside of the paperboard laminate during the shrink-wrap operation. For automobile fenders, hoods, the paperboard laminate need not be cut out and the sides of the paperboard laminate are folded upwardly to form a carton bottom to which a lid is affixed for shipping.

Moreover, U.S. Pat. No. 7,458,465 teaches a protective package for an automobile part by providing a carton, side rail supports in the carton to receive the part and padded supports to secure the part in the carton.

Furthermore, U.S. Pat. No. 6,679,378 relates to a device for storing and transporting flat, substantially two dimensional objects where the device comprises a frame in which pouches with substantially u-shaped cross-sections are suspended and into each of which a corresponding object can be inserted.

Furthermore, there have been various activities utilizing materials to reinforce packaging particularly when the package is comprised of corrugated paperboard. For example, U.S. Pat. No. 6,095,061 relates to a pallet which includes a number of runners which are sandwiched between upper and lower face sheets of corrugated paperboard. Each runner is comprised of multiple layers of corrugated paperboard which the flutes of the corrugations oriented vertically to provide compression strength to the runners and the associated pallet. Each runner also includes at least one reinforcing insert most preferably of hardwood to provide beam strength to the runner.

It is an object of this invention to provide an improved package for protecting parts during shipment and in particular to provide an improved package for protecting vehicle hoods during shipment and the method relating to same.

It is an aspect of this invention to provide a container for a part having a protrusion comprising: a paperboard container having an end; fiberboard disposed at said end of said container; said fiberboard having a hole therein for receiving the protrusion of the part. In one embodiment the container comprises corrugated paperboard and the part comprises a hood having a protruding latch striker.

It is another aspect of this invention to provide a package for a vehicle hood having a protruding latch striker comprising: a corrugated paperboard bottom having spaced front, back and side walls; a block disposed on said bottom adjacent to the front wall; fiberboard connected to said block, said fiberboard having a hole therein for engagement with the protruding latch striker when the hood is placed in the bottom; a lid engageable with the walls. In one embodiment the invention presents a block having a bottom section and a top section where the top section presents the fiberboard having the hole. In another embodiment the bottom section of the block comprises a plurality of laminated corrugated paperboard adhesively stacked to one another and the top section comprises a plurality of laminated fiberboard adhesively stacked to one another; such stacked laminated fiberboard adhesively connected to the laminated corrugated paperboard and wherein the holes of the laminated stacked fiberboard are aligned.

Yet another aspect of this invention relates to a method of packaging a vehicle hood having a protruding latch striker comprising the steps of: placing at least one piece of fiberboard having a hole therein into the package; inserting the vehicle hood into the package with the protruding latch striker engaging the hole of the fiberboard; placing a lid on the package.

These and other objects and features shall now be described in relation to the following drawings.

DESCRIPTION OF DRAWINGS

FIG. 7 illustrates a fibre board or edge board block sheet having a hole there through.

FOLLOWING IN DETAILED DESCRIPTION OF THE INVENTION

Lake parts have been described with lake numbers throughout the figures. The drawings are not necessarily to scale.

Figure 1:
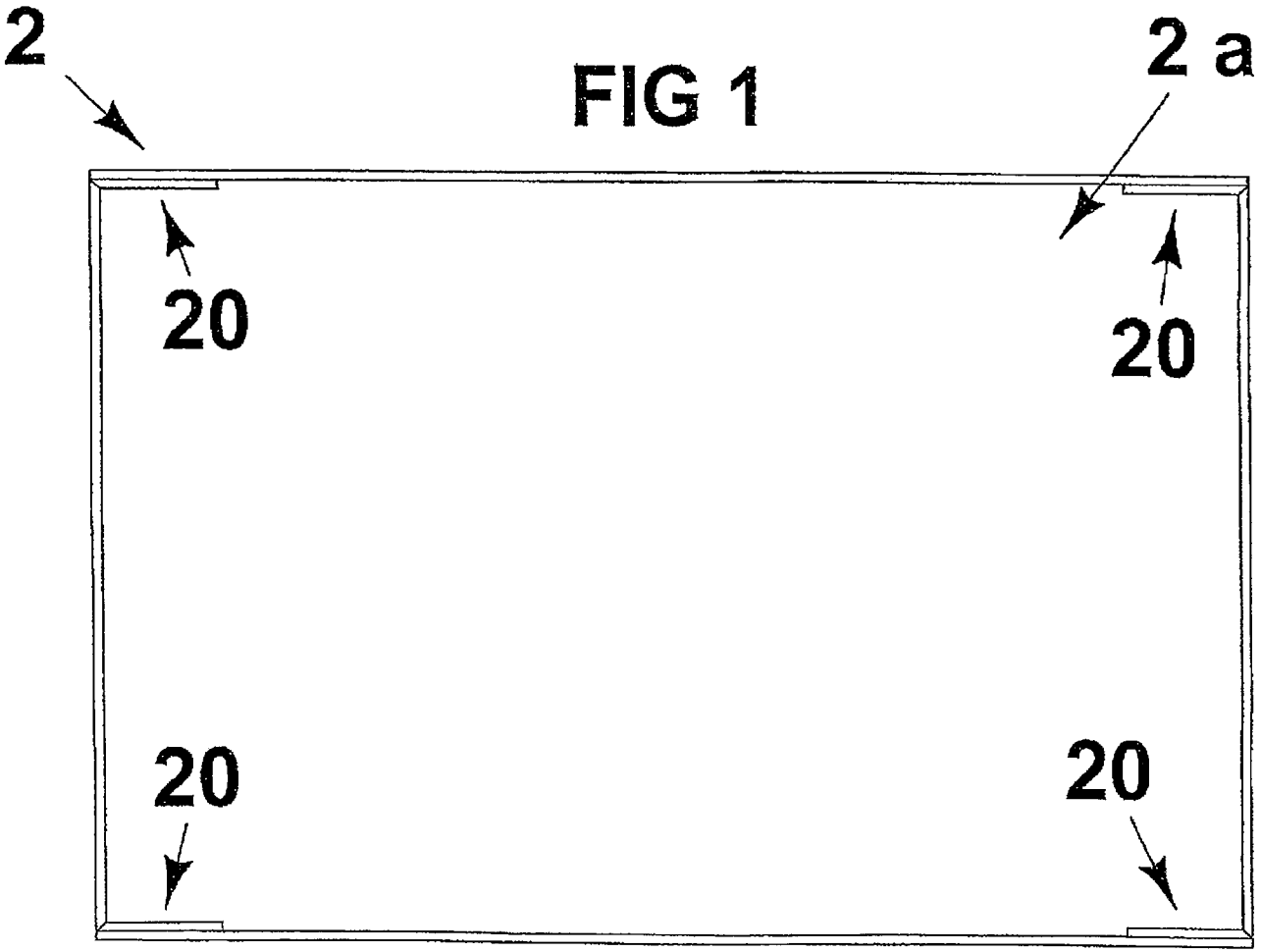
FIG. 1 is a top plan view of the lid.
Figure 2:
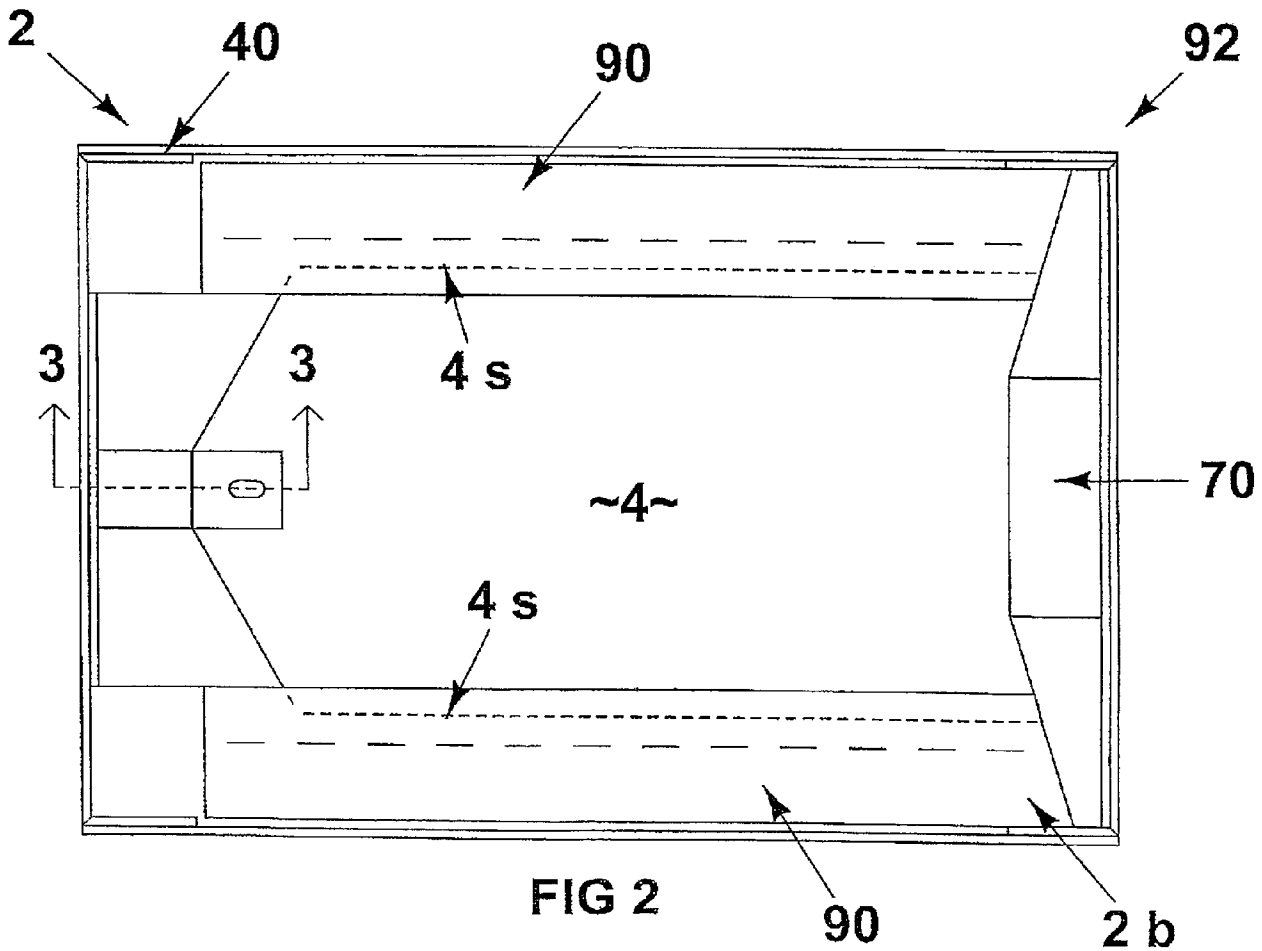
FIG. 2 is a top plan view of the bottom of the container with a hood.
Figure 3:
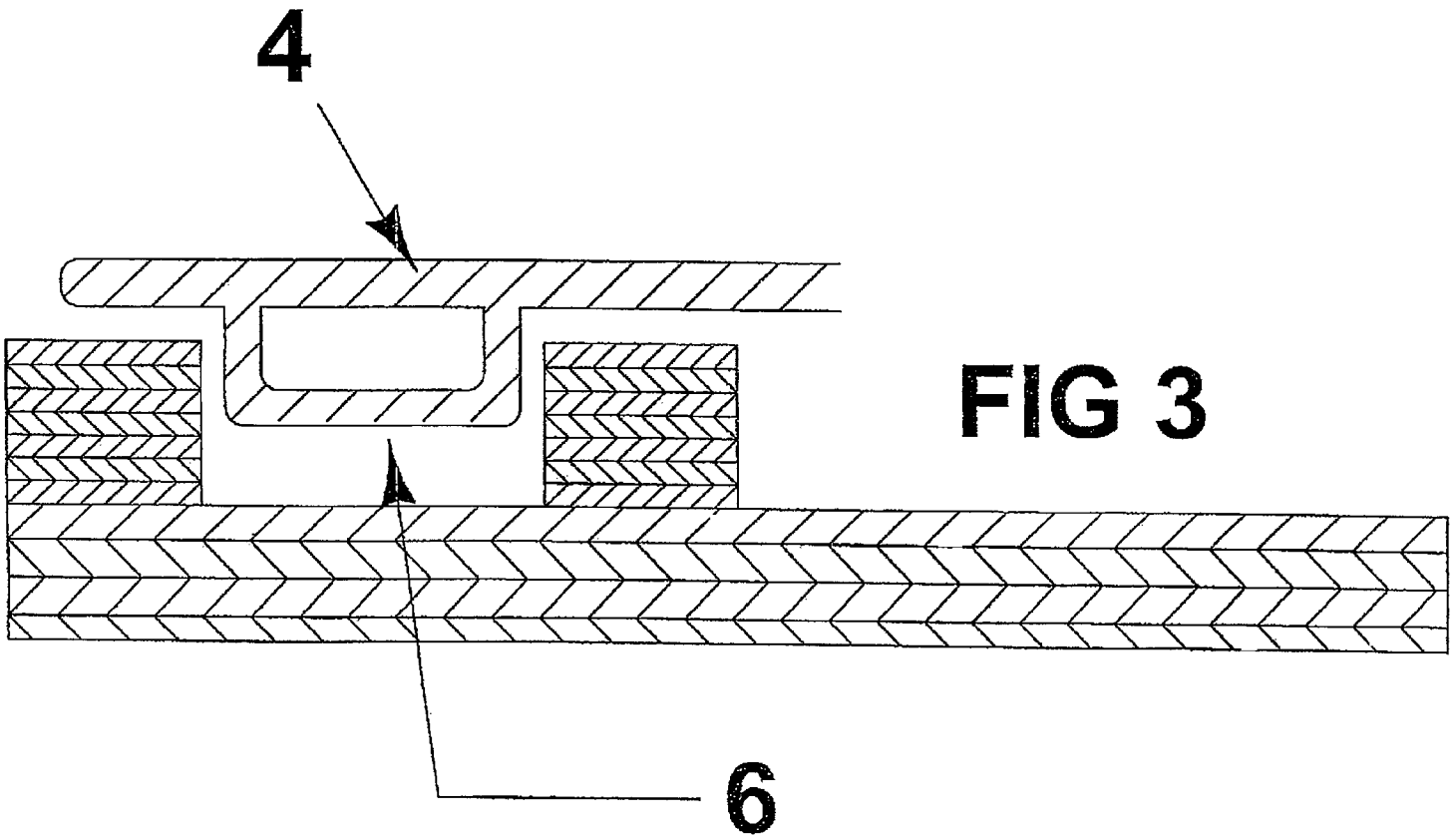
FIG. 3 is a cross sectional view of FIG. 2 taking along the lines 3-3 of FIG. 2.

FIGS. 1 and 2 are generally illustrate a container or package which comprises of lid 2*a* and bottom or body 2*b*. The container 2 as illustrated is utilized to ship a part having a protrusion 6. The part 4 generally can comprise of any variety of parts having a protrusion but in the embodiment described herein relates to a hood of an automobile having a latch-striker 6. However, the invention can also be utilized for any number of parts having a protrusion including a trunk of an automobile or the like.

Figure 4:
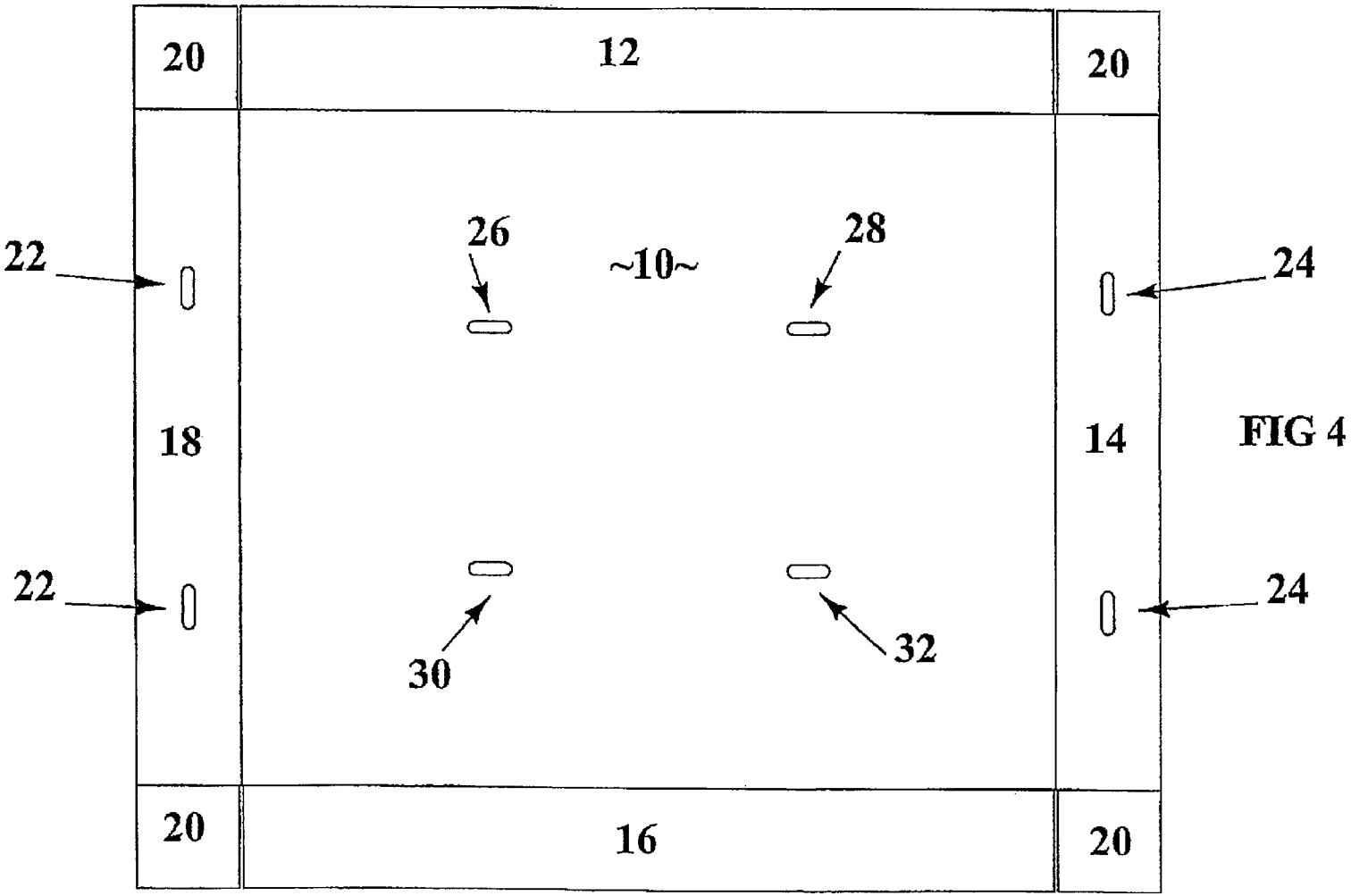
FIG. 4 is a top plan view of the lid showing the die-cuts from a corrugated paperboard.

FIG. 4 illustrates the die-cuts that can be made from a sheet of corrugated paperboard so as to produce the lid having lid sidewalls 12, 14, 16, 18 with flaps 20 so as to produce a lid in a manner well known to those persons skilled in the art. The lid as well as the sides 14 and 18 can include a number of slots 22, 24, 26, 28, 30 and 32 which are adapted to engage tabs in a manner to be described herein.

Figure 5:
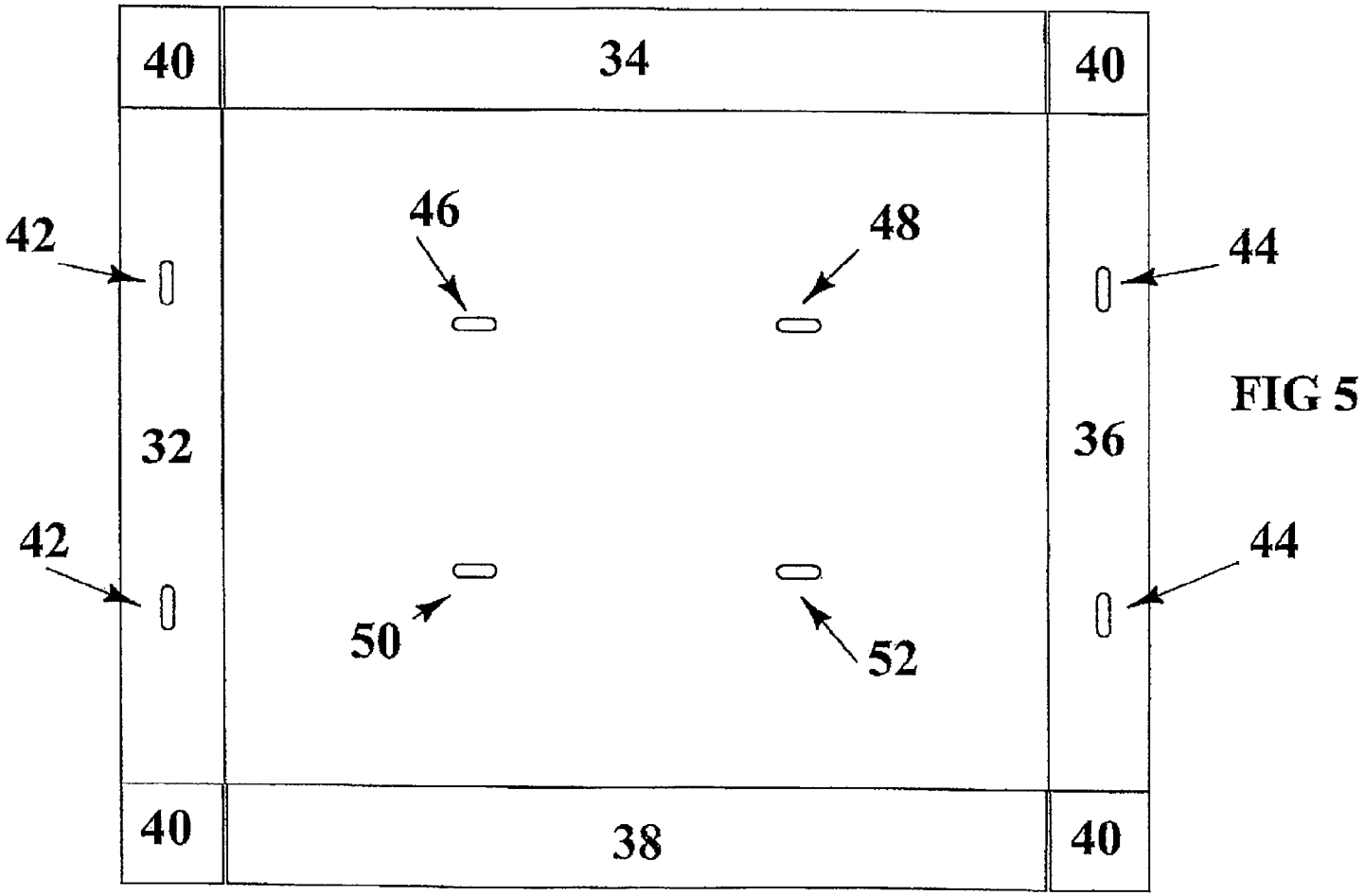
FIG. 5 is a top plan view of the body or bottom showing the die-cuts from a corrugated paperboard.
Figure 7:
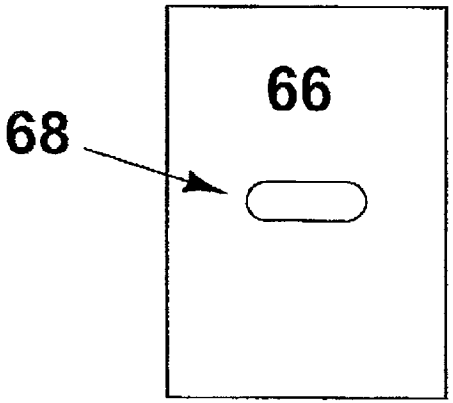
Figure 6:
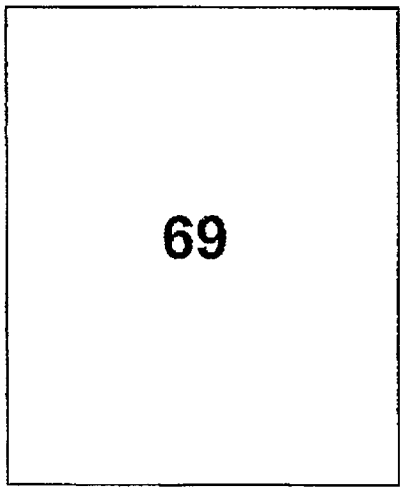
FIG. 6 illustrates a corrugated block sheet.

FIG. 5 shows a top plan view of the die-cut from a piece of corrugated paperboard to produce the body 2*b* having a front wall 32, back wall 36, and two sides 34 and 38 as described. The body 2*b* also includes reinforcing tabs 40 to produce the bottom half of the body in a manner well known to those persons skilled in the art. The body 2*b* also includes slots 42, 44, 46, 48, 50 and 52.

The bottom of the container 2*b* is adapted to receive a front insert 50, a back or rear insert 70 and 2 spaced side inserts 90.

Figure 9:
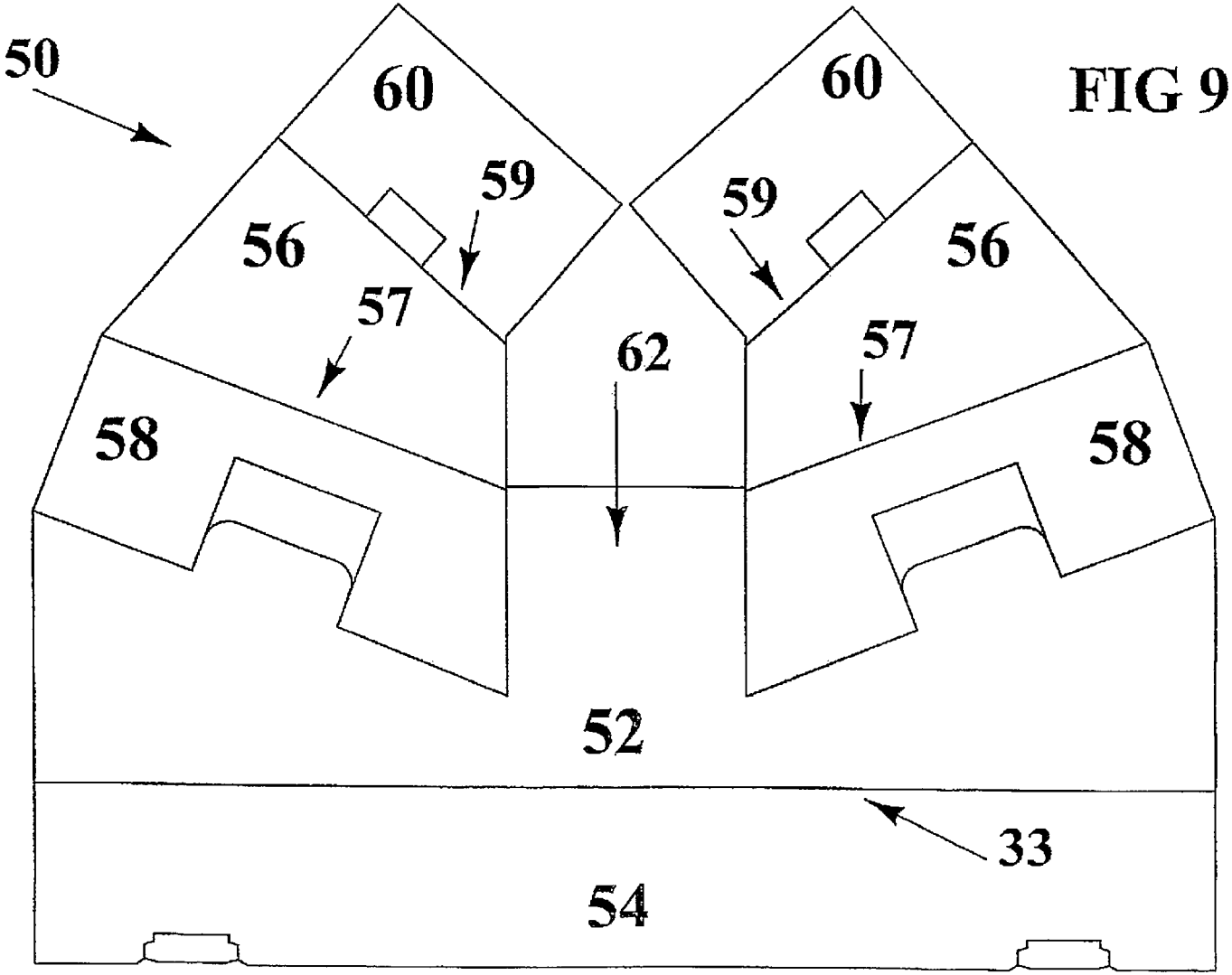
FIG. 9 is a top plan view showing the die-cut of the front insert from a corrugated sheet.
Figure 10:
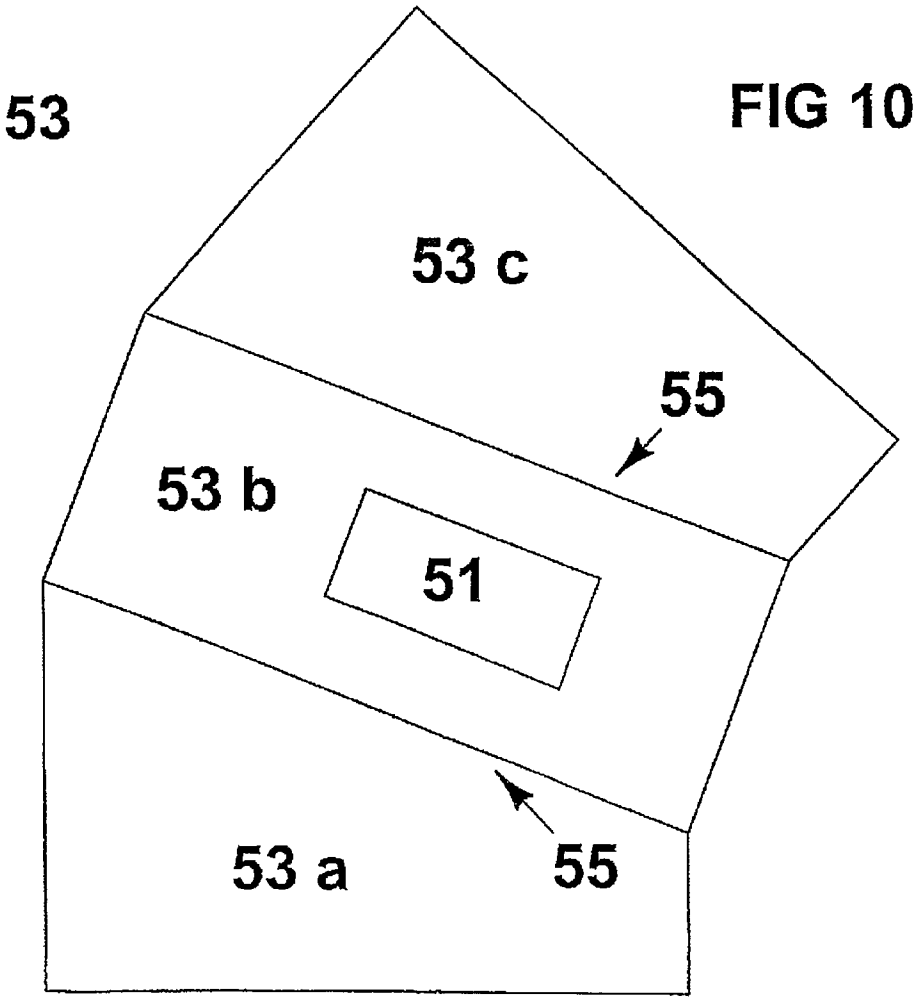
FIG. 10 is a top plan view of the die-cut to form the front reinforcement.

The front insert 50 can be constructed from a sheet of corrugated paperboard as shown in FIG. 9 which comprises a front bottom section 52, front upstanding sidewall 54 which is produced by folding front upstanding sidewall 54 relative to the front bottom section 52 along fold line 33.

The front insert 50 also includes front cushioning sections 56 which are produced by folding panels 58 and 60 about fold lines 57 and 59 as shown.

The central region 62 of the front insert 50 is adapted to receive the reinforcing block 64 which is adapted to engage with the protrusion 6 as previously described.

The block 64 comprises at least 1 fiberboard sheet 66 having a slot 68 there through. In the embodiment shown in FIG. 8, there are 7 laminated sheets of fiberboard adhesively bonded to one another all of which have a hole there through for engaging the latch-striker of an automobile hood.

The block 64 can also include a corrugated block sheet 69 made from corrugated sheet. In the embodiment shown in FIG. 8 there are 4 corrugated block sheets which are adhesively bonded to one another in a laminate fashion; with the fiberboard block sheets laminated to the corrugated block sheets. The block 64 is disposed on the central section 62 on the front bottom 58 adjacent to the front wall 32 of the bottom or body to 2*b*. The fiberboard 66 having the hole 68 there through is adapted to engage and retain the protruding latch-striker 6 of the hood 4 when it is placed in the bottom of the container 2*b*.

In one embodiment the invention presents a block 64 having a bottom section 69 and a top section 66 where the top section 66 presents the fiberboard having the hole of 68 there through. In another embodiment, the bottom section 69 of the block 64 comprises a plurality of laminated corrugated paperboard adhesively stacked to one another and the top section comprises of a plurality of laminated fiberboard adhesively stacked to one another such that the stacked laminated fiberboard adhesively connected to the laminated corrugated paperboard and were the holes of the laminated stacked fiberboard are aligned.

Any variety of adhesive can be used and in one embodiment comprises hot adhesive which is applied to the various sheets.

Figure 8:
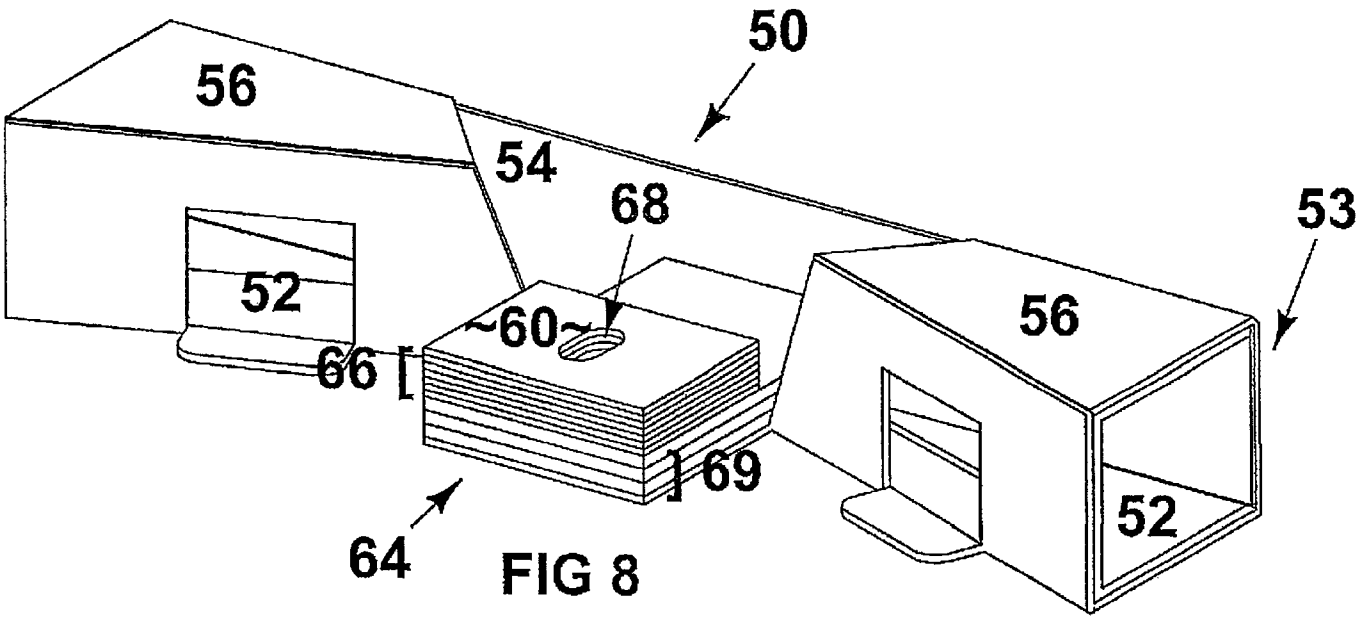
FIG. 8 illustrates a three dimensional view of the front insert.

The front insert 50 can also include a front reinforcement 53 which comprises of panels 53*a* 53*b* and 53*c* which are folded along fold lines 55 and inserted into the ends 56 as shown in FIG. 8 so as to reinforce the front insert section 50. The panel 53*b* also includes a hole 51.

Figure 12:
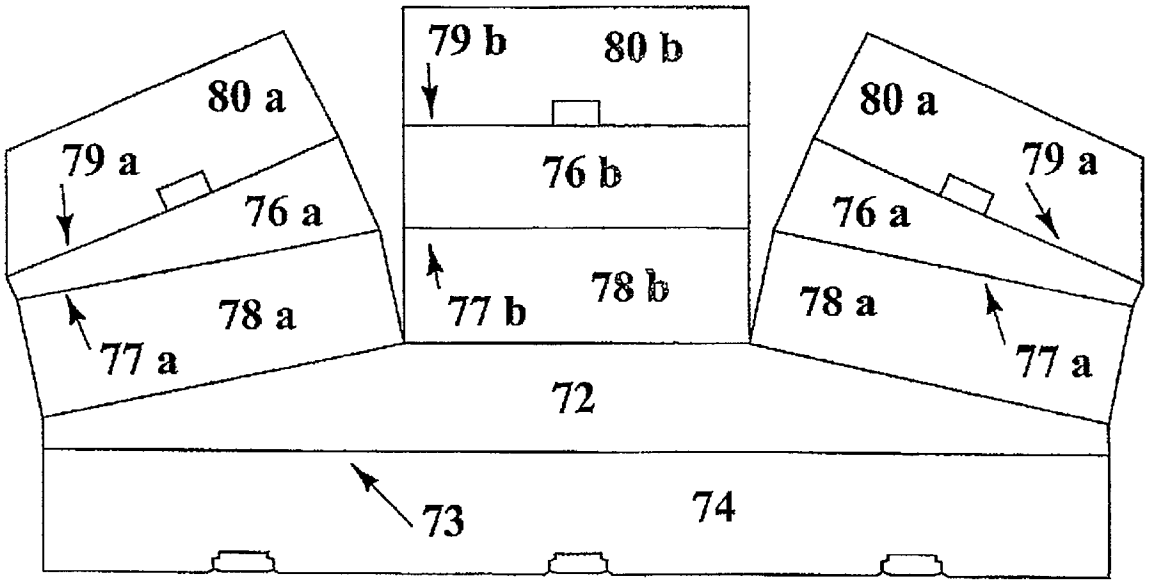
FIG. 12 is a top plan view of the die-cut from a corrugated sheet to form the back insert.

The back or rear insert 70 can be produced from a sheet of corrugated paperboard which is die-cut as shown in FIG. 12 so as to produce a rear bottom section 72 and a rear upstanding side wall 74 folded about the fold line 73.

Figure 11:
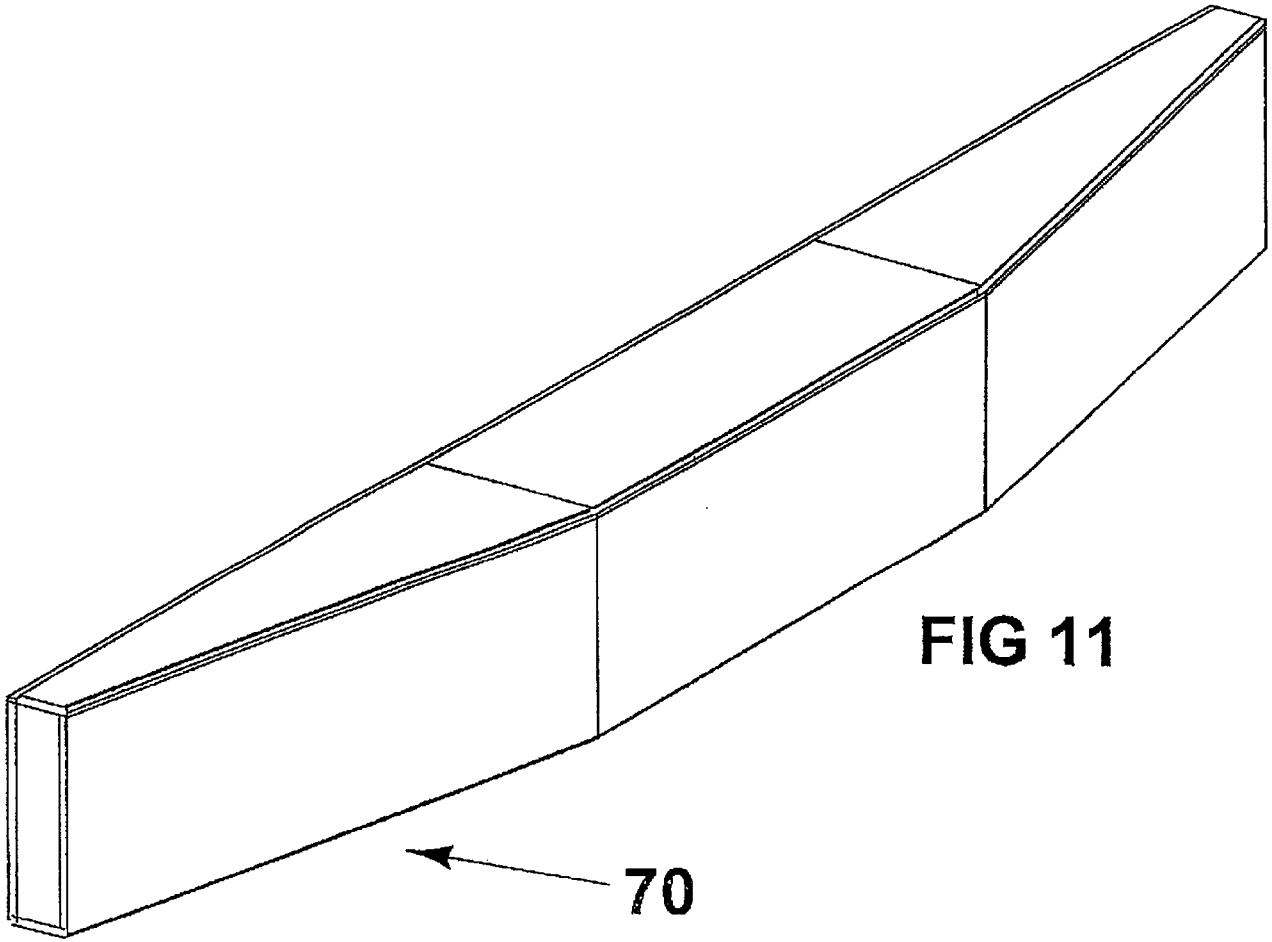
FIG. 11 is a three dimensional view of the back insert.

Furthermore, panels 76*a*, 78*a* and 80*a* are folded about fold lines 77*a* and 79*a* so as to produce the back or rear section as shown in FIG. 11. Moreover, panels 76*b* is folded relative to panel 78*b* and panel 80*b* about fold lines 77*b* and 79*b* so as to produce the rear insert 70 as shown in FIG. 11. The rear insert 70 is inserted into the bottom of the containers 2*b* as shown in FIG. 2 and rest up against the rear portion hood 40.

Figure 13:
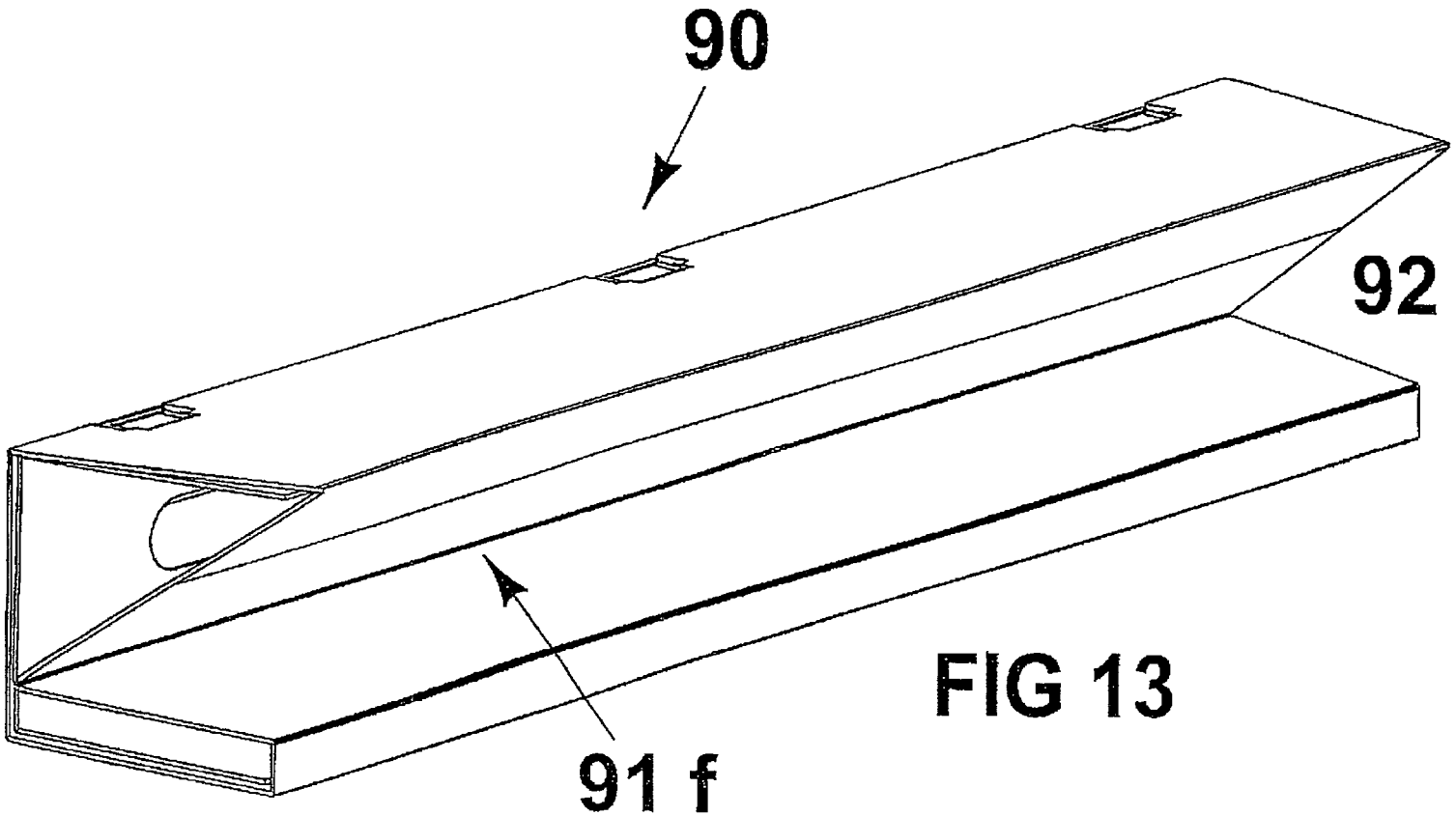
FIG. 13 is a three dimensional view of the sides.
Figure 14:
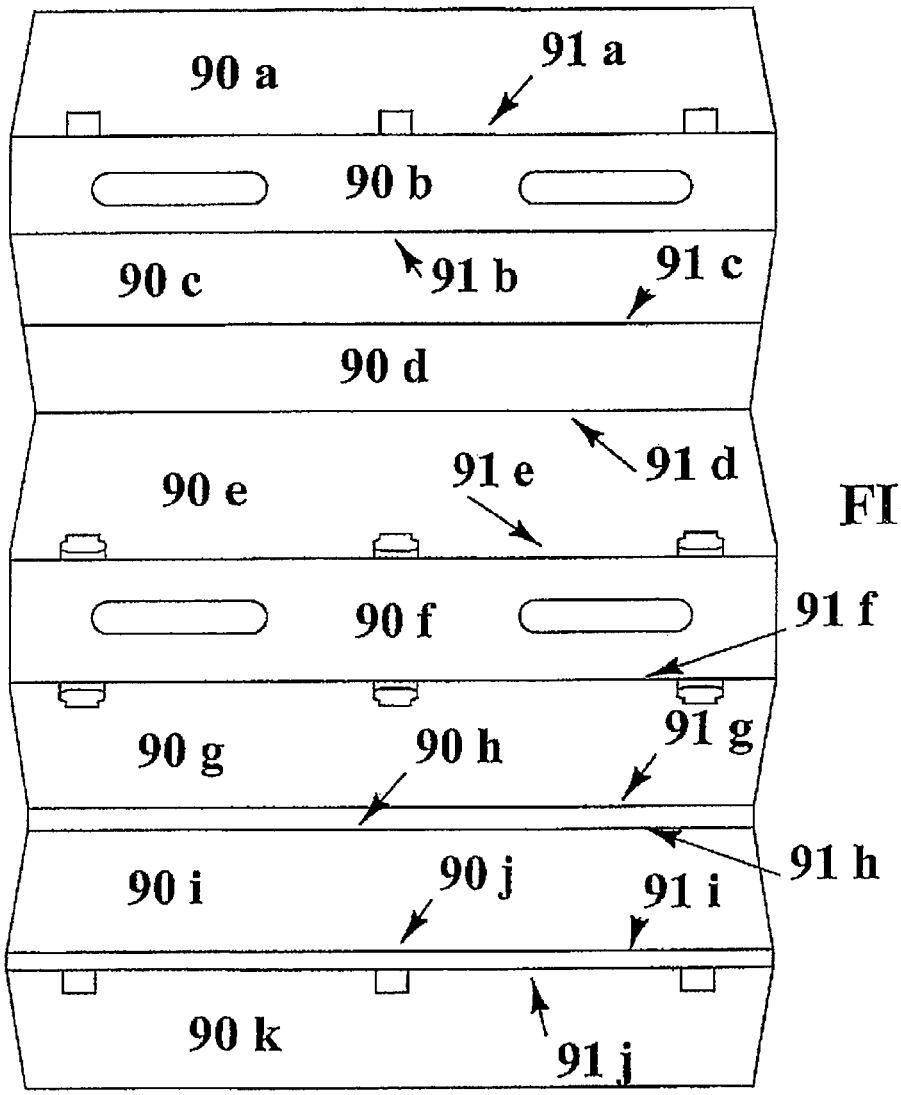
FIG. 14 is a top plan view of the die-cut from a corrugated sheet to form the sides.

Furthermore, sides 90 are produced from the die-cut sheet of corrugated paperboard as shown in FIG. 14. More particularly, panels 90*a*, 90*b*, 90*c*, 90*d*, 90*e*, 90*f*, 90*g*, 90*h*, 90*i*, 90*j*, and 90*k* are folded about fold lines 91*a*, 91*b*, 91*c*, 91*d*, 91*e*, 91*f*, 91*g*, 91*h*, 91*i* and 91*j* so as to produce the side inserts 90 as shown in FIG. 13. The side inserts include a cavity 92 as shown and is adapted to receive the side edges of the hood 4 as shown in FIG. 2.

The container as described herein provides an improved shipping container for heavy objects having a protrusion such as the hood of an automobile. Prior to the invention described herein, it was quite common to receive a dented or damaged hood that had been shipped by courier or the like. Quite often the container or packages was dropped and due to the heavy nature of the automobile hood, the part would have arrived in a damaged condition.

Various tests have been conducted with the invention described herein. In one such test the container having the fiberboard reinforcement was dropped from a height of 30 inches from the floor, where the block 64 as described herein retained the hood in the desired protected position within the container 2 without any damage being sustained by the automotive hood.

Accordingly, the invention is described herein relates to a method of packaging a part having a protrusion including a vehicle hood having a protruding latch-striker which comprises of steps of placing at least one piece of fiberboard having a hole therein in the package; inserting the vehicle into the package with the protruding latch-striker engaging the hole of the fiberboard; and placing a lid on the container.

We claim:

1. A container for a part having a protrusion comprising:

(a) a paperboard container having a bottom, a front and, two spaced sides and a back end;

(b) fiberboard disposed on said bottom for a portion at said front and spaced from said sides and back end of the said container;

(c) said fiberboard having a hole therein for receiving the protrusion of the part; said hole surrounded by said fiberboard;

(d) wherein said fiberboard is presented by a block and said hole disposed substantially perpendicular to said bottom (e) wherein said block includes a plurality of stacked fiberboard sheets having aligned holes there through; and (f) herein said block includes an upper section and a bottom section; said upper section including a plurality of stacked fiberboard sheets and said bottom section including a plurality of stacked paperboard sheets; said upper section disposed further from said front end than said bottom section.

2. The combination of container and an automotive hood having a protruding latch-striker wherein:

the container comprises (i) a paperboard container having a front wall, two spaced side walls and a back wall and an opening;

(ii) a plurality of stacked fiberboard sheets with a hole therein for receiving the latch-striker of the hood, said plurality of stacked fiberboard sheets adjacent for a portion of said front wall and spaced from said side walls, and beck wall (iii) wherein the plurality of stacked fiberboard is presented by a block;

(iv) wherein the block includes an upper section and a lower section; the upper section including the plurality of stacked fiberboard sheets and the bottom section including a plurality of stacked paperboard sheets;

(v) wherein the upper section is disposed further away from said front wall than said bottom section.

3. A container as claimed in claim 2 wherein said plurality of fiberboard stacked sheets is adhesively bonded to one another.

4. A container as claimed in claim 3 wherein said plurality of stacked corrugated paperboard are adhesively bonded to one another and bonded to the fiberboard.

5. A container as claimed in claim 4 including a lid engaging the bottom.

6. A package for a vehicle hood having a protruding latch-striker comprising:

(a) a corrugated paperboard bottom having spaced front, back and sidewalls;

(b) a block disposed on said bottom adjacent to the front wall, the block spaced from said back and side walls, (c) a block having an upper section and a lower section; the upper section including the plurality of stacked fiberboard sheets and the bottom section including a plurality of stacked paperboard sheets; wherein the upper section is disposed further away from said front than said bottom section, said block having a hole therein for engagement with the protruding latch-striker when the hood is placed at the bottom;

(d) a lid engageable with the side walls.

7. A package as claimed in claim 6 wherein said plurality of stacked paperboard sheets are adhesively stacked to one another and the top section comprises of plurality of laminated fiberboard adhesively stacked to one another, said stacked laminated fiberboard adhesively connected to the laminated corrugated paperboard and wherein the holes of the laminated stacked fiberboard are aligned.

8. A package as claimed in claim 7 where in said adhesive is a hot melt adhesive.

9. A package as claimed in claim 8 including a rear insert.

10. A package as claimed in claim 9 including side inserts.

11. A container for a part having a protrusion comprising:

(a) the container having a bottom, a front end, two spaced sides and a back end;

(b) a block disposed on said bottom for a portion of said front end and spaced from said sides and back end, said block having an upper section and a bottom section; said upper section including a plurality of stacked fiberboard sheets and said bottom section including a plurality of stacked paperboard sheets; said upper section disposed further from said front end than said bottom section;

(c) said upper section having a hole therein for receiving the protrusion of the part.

12. A container as claimed in claim 11 wherein the plurality of stacked fiberboard sheets and the plurality of stacked paperboard sheets are adhesively bonded to one another.

* * * * *